US007665148B2

(12) United States Patent
Zorica

(10) Patent No.: US 7,665,148 B2
(45) Date of Patent: Feb. 23, 2010

(54) MINIMALLY SEAMED FITTED GARMENT

(76) Inventor: Alistair Zorica, P.O. Box 138, Torquay, Victoria (AU) 3228

( * ) Notice: Subject to any disclaimer, the term of this patent is extended or adjusted under 35 U.S.C. 154(b) by 597 days.

(21) Appl. No.: 10/516,850

(22) PCT Filed: Sep. 5, 2002

(86) PCT No.: PCT/US02/28450

§ 371 (c)(1),
(2), (4) Date: Jun. 23, 2005

(87) PCT Pub. No.: WO03/103423

PCT Pub. Date: Dec. 18, 2003

(65) Prior Publication Data

US 2005/0241044 A1 Nov. 3, 2005

(30) Foreign Application Priority Data

Jun. 5, 2002 (AU) ..... PS 2796

(51) Int. Cl.
*B63C 11/04* (2006.01)
*B63C 11/00* (2006.01)

(52) U.S. Cl. ..... 2/2.15; 2/2.16; 2/2.17

(58) Field of Classification Search ..... 2/2.15, 2/2.16, 2.17
See application file for complete search history.

(56) References Cited

U.S. PATENT DOCUMENTS 2,201,980 A * 5/1940 Walter et. al. ..... 66/200
2,215,780 A * 9/1940 Donning ..... 33/14
2,231,436 A * 2/1941 Cieri ..... 33/15
2,231,437 A * 2/1941 Cieri ..... 33/15
2,554,940 A * 5/1951 Clyne ..... 2/93
2,570,019 A * 10/1951 Wolk ..... 2/2.15
2,582,811 A * 1/1952 Williams ..... 2/2.17
2,664,566 A * 1/1954 Mianulli ..... 2/457
2,705,326 A * 4/1955 Lahnstein et al. ..... 2/83
3,255,459 A * 6/1966 Way ..... 2/2.17
3,305,423 A * 2/1967 Le Masson ..... 2/458
3,329,966 A * 7/1967 Slavick ..... 2/2.15
3,614,789 A * 10/1971 Menut ..... 2/93
3,731,319 A * 5/1973 O'Neill ..... 2/2.17
3,744,052 A * 7/1973 Rector ..... 2/2.15
3,745,656 A * 7/1973 Sweeney ..... 33/14
3,763,498 A * 10/1973 Rector ..... 2/2.15
4,416,027 A * 11/1983 Perla ..... 2/275
4,473,908 A * 10/1984 Knecht ..... 2/115
4,809,364 A * 3/1989 Lent ..... 2/2.15
4,862,517 A * 9/1989 Meistrell ..... 2/2.17
4,907,295 A * 3/1990 Yasuda ..... 2/2.16
5,740,553 A * 4/1998 Knapp ..... 2/74
5,768,703 A * 6/1998 Machado et al. ..... 2/2.15
5,898,934 A 5/1999 Hunter et al. ..... 2/2.15
5,978,960 A * 11/1999 Wrightman ..... 2/2.15
6,219,841 B1 4/2001 Anderson ..... 2/2.17
6,357,048 B2 * 3/2002 Griffiths ..... 2/2.17

(Continued)

*Primary Examiner*—Bobby H Muromoto, Jr.

(57) ABSTRACT

Garments that utilize complex panel shapes to minimize the to number of panels used, the number of seams, and total seam length. Increasing the complexity of panel shapes tends to make the cutting of panels more difficult and often results in more wastage of material, but the reduction of the number of panels and reduction in the number of seams and total seam length will actually simplify garment production and result in improved garments. Simplifying garment production will in turn generally result in an increase in the rate of production. Reducing seam length and the number of seams also reduces the chances of seams wearing out or splitting.

21 Claims, 5 Drawing Sheets

U.S. PATENT DOCUMENTS

| | | | | |
|---|---|---|---|---|
| D456,110 | S * | 4/2002 | Fairhurst et al. | D2/731 |
| 6,415,440 | B1 * | 7/2002 | Stinton | 2/2.17 |
| D461,033 | S * | 8/2002 | Fairhurst et al. | D2/732 |
| 6,434,749 | B1 * | 8/2002 | Grounds et al. | 2/2.15 |
| 6,446,264 | B2 * | 9/2002 | Fairhurst et al. | 2/69 |
| 6,526,584 | B1 * | 3/2003 | Hunter | 2/2.16 |
| D510,175 | S * | 10/2005 | Ragot et al. | D2/731 |
| 2001/0047530 | A1 * | 12/2001 | Griffiths | 2/2.17 |
| 2002/0023283 | A1 * | 2/2002 | Kania et al. | 2/2.15 |
| 2003/0024028 | A1 * | 2/2003 | Sleesen | 2/2.17 |
| 2005/0005337 | A1 * | 1/2005 | Yokoyama | 2/2.15 |
| 2007/0277278 | A1 * | 12/2007 | O'Brien | 2/2.17 |

* cited by examiner 72
66
68
70
58'
60
62'
62'
64'
56'
48'
48
50'
52'
50
52
46
38
46'
54
58
62
62
64
56
40
42'
42
43'
43
45'
45
44'
44

MINIMALLY SEAMED FITTED GARMENT

This application claims the benefit of Australian provisional patent application number PS2796 filed on Jun. 5, 2002 incorporated herein by reference in its entirety.

FIELD OF THE INVENTION

The present invention relates generally to fitted garments of the type intended to closely conform to the shape of a wearer's body. The invention also relates to methods of fabricating such garments.

The invention has particular application to the production of wetsuits for use in water sports such as surfing, sailboard riding, water skiing, diving, swimming or other similar activities. However, the invention is not limited to this particular application and may be employed in other types of fitted garments.

BACKGROUND OF THE INVENTION

Fitted garments are garments of the type that closely conforms to the shape of the wearer's body. A wetsuit is one example of such a garment wherein a snug fit of the garment assists in creating a thin layer of water between the fabric of the garment and the skin of the body. This thin layer of water forms a major part of the insulation provided by the wetsuit. It is therefore advantageous that no additional water enters the wetsuit once the initial layer has been established and has been warmed by the body.

Fitted garments such as wetsuits are fabricated from a plurality of panels that are joined together at seams that are sewn and, optionally, glued. A pattern incorporating a plurality of panels of varying shapes and sizes is used to produce a wetsuit or other garment that is "sculptured" to closely conform to the shape of a wearer's body. As a result of the garment conforming to the shape of a wearer's body, the different parts of a garment will often be referred to as if they were filled by and/or were part of a wearer's body. Thus, the "elbow" or "elbow section" of a garment will be the portion of the garment that would be adjacent to the elbow of a wearer if the garment was being worn. This nomenclature is often applied to panels as well, even if the panels are not yet actually part of a garment, and even if the panels are laid out flat on a supporting surface such as a table.

Panels, as the term is used herein, typically comprise a single piece of material cut to a desired pattern that can be made to lay flat on a flat surface such that no portion of the panel overlaps any other portion of the panel. Panel materials may include fabric, but are not necessarily limited to a woven material. When stretched against a planar surface, panels will generally have significantly more surface area than thickness (thickness being measured in a direction normal to the planar surface, and surface area being measured on a surface of the panel that is closest to being parallel to the planar surface). Panels are generally cut from piece goods or yard goods that are sometimes provided as rectangular pieces of material, with multiple, often differently shaped, panels, being cut from a single piece in order to minimize wastage of material.

Panels are joined together at seams, where a seam is a portion of the garment where two or more panels are coupled together. Various methods of fastening together panels to form a garment are well known and need not therefore be described herein. However, it is probably worth noting that, particularly in regard to wetsuits, seams typically incorporate "flat locking", "overlocking", "glued and blind stitching" and/or "heat tape sealing" techniques. These techniques are commonly used in the trade and need not therefore be explained herein in further detail. Whilst the seams are in general strong and reliable, they are susceptible to wear and damage with extended use of the wetsuit. The seams are also a source of water entry into the wetsuit and this factor can significantly reduce the effectiveness of the wetsuit in keeping the wearer warm.

Garments generally comprise multiple types of panels. Of particular interest herein are exterior covering panels. These panels are the panels of a garment that typically are (a) used to cover undergarments, interior panels, or portions of a wearer's body, and (b) to form an exterior surface of the garment. In garments having simpler exteriors, such as wetsuits, the exterior covering panels form a majority if not all of the exterior surface of the garment Other garment panels may include those used to form pockets, flaps, and liners, or those used to form exterior frills or decorations. Athough the term "panels" generally covers all types of panels, it is used herein below to describe only exterior covering panels. Similarly, although seams are used to join all types of panels, the term "seams" is used herein below to describe exterior covering seams, i.e. seams joining exterior covering panels to each other.

Some garments utilize "darts" (generally tapered folds) to adjust the fit of a garment. Such a dart typically comprises joining two or more points of a single panel together if they were part of edges of separate panels being seamed together. Unfortunately, traditional darts tend to become problematic as the thickness of the material of a panel increases as the folded portions of the panel tend to interfere with proper fitting of the garment.

Many fabrics used in garment production are well know and need not therefore be described in detail herein. However, it is worth noting that typical fabrics used in the fabrication of wetsuits include nylon, spandex, polyolefin, or combinations of these materials, which have been bonded to a neoprene (non-fibrous rubber) insulative layer. Various thicknesses of fabric are employed depending on the temperature rating of the wetsuit. These materials are in general flexible and stretchable so as to allow free movement of the wearer. This is important in a wetsuit intended for vigorous activity such as surfing. Whilst the techniques employed to create the seams of a wetsuit also provide flexibility and stretchability, the seams are often not as flexible as the fabric being joined.

Modern wetsuits primarily intended for surfing are sometimes provided with bends at the elbows and knees so as to more accurately correspond to a normal position of the arms and legs of the wearer when lying upon or standing on a surfboard. Whilst this is an advantage to the wearer it does mean that the wetsuit must include additional panels of appropriate shape and size such that, when joined together, they form the desired three dimensional body shape and the desired angle at the elbows and knees.

SUMMARY OF THE INVENTION

A general object of the present invention is to produce garments that utilize complex panel shapes to minimize the total number of panels used, the number of seams, and total seam length. It is contemplated that, although increasing the complexity of panel shapes tends to make the cutting of panels more difficult and often results in more wastage of material, the reduction of the number of panels and reduction in the number of seams and total seam length will actually simplify garment production and result in improved garments. Simplifying garment production will in turn generally result in an increase in the rate of production. Reducing seam length and the number of seams also reduces the chances of seams wearing out or splitting.

One type of garment that is improved by panel and seam reduction is a wetsuit. Wetsuits having reduced panel numbers and seam length will generally keep a surfer warmer and more comfortable and flexible than existing wetsuits. Reduced seam length will reduce water entry into the suit and the reduction in water entry increases surfer warmth.

To a large extent, wetsuits are used herein to described the claimed invention as the lack of frills and other exterior decorations on wetsuits make them well suited for illustrating various aspects of garments. However, the aspects of the invention are generally applicable to garments in general, and not only to westuits.

One aspect of the present invention provides a fitted garment including a first panel of fabric having a torso section which is shaped to substantially surround the waist region of a wearer's body and which has upper portions configured to extend outwardly in the finished (having all its panels sewn together) garment to an underarm region of the body such that no seams are present within the armpit region of the body. A wetsuit produced in accordance with this aspect of the present invention minimizes the seams which are necessary around the waist region of the body and avoids seams altogether within the armpit region of the body. These features provide major advantages in terms of warmth and comfort.

In one embodiment, the first panel of the garment also includes leg sections integrally formed with the torso section. In this way, the number of seams in the garment is further minimized. Preferably, each leg section is configured to substantially surround at least an upper portion of a leg of the body. However, the leg sections may enclose the whole leg down to the ankle.

In a preferred embodiment the garment includes a second panel joined to the first panel and having at least a first arm section and a first upper back section formed integrally therewith. The first arm section may form a sleeve for the garment, either short or long, and the first upper back section is preferably configured to extend across at least a portion of the upper back of the body. A third panel having a second arm section and a second upper back section formed integrally therewith may also be joined to the first panel. The second arm section preferably forms a second sleeve, either short or long, and the second upper back section is preferably configured to extend across at least a portion of the upper back of the body and may meet the first upper back section adjacent a spinal region of the body. A zipper may be provided between the first and second upper back sections to enable the wearer to easily step into or out of the garment when the zipper is down, i.e. unzipped. The position and function of the zipper may be similar to that of conventional wetsuits.

In an alternative preferred form of the garment a second panel may be joined to the first panel and include integrally formed arm sections, upper back sections and a chest section. In this form of the finished garment the arm sections form a pair of sleeves, the upper back sections extend between the sleeves across the upper back of the body to meet at a spinal region thereof, and the chest section extends between the sleeves across a chest region of the body. In this way, the number of seams in the garment are further reduced, thereby further improving the insulative properties, comfort and flexibility of the garment.

Another aspect of the invention provides a fitted garment including leg sections being configured to closely conform to the shape of a human body wherein each leg section is made of a single panel of fabric and includes a dart which in the finished garment begins at a seam on an inner knee region of the body and terminates at an outside calf region. A "dart", as the term is used herein is similar to a traditional dart in that portions of a single panel are joined together. However, the portions joined are not separated by a fold in the panel, but instead are formed by joining edges of a single panel together. As such, panels that are to be shaped by darts will have regions separating points to be joined together removed such that the points to be joined fall on or near two or more edges of the panel. Such edges will often form opposite sides of a gap in the panel when the panel is stretched against a flat surface. Darts are generally described herein in regard to the portions on the panel at the ends of the dart and possibly along the length of the dart. Since the removed region corresponding to each dart may be described in the same fashion, any descriptions as to the location of darts will also apply be applicable the corresponding dart gap/removed region.

The leg sections of such a garment more closely conform to the shape of a human body by using a dart in the region of the knee and calf. Preferably, the dart, and the corresponding removed region, extends from the inner knee region, over the front of the knee and down the outside of the calf. This assists in creating a desired three-dimensional shape for the garment.

A garment according to this aspect of the invention may also employ such a dart to create a bend at a knee region of the leg such that the thigh section forms an angle to the calf/shin section. In this way, the leg sections of the garment can be fabricated to more closely reflect the usual position of a surfer's legs without the need to introduce additional panels into the leg sections of the garment.

A further aspect of the invention provides a fitted garment having a pair of sleeves configured to closely conform to the shape of a human body and having a bend at an elbow region thereof such that a forearm section of the sleeve forms an angle to an upper arm section of the sleeve, wherein each sleeve is made of a single panel of fabric and said bend is provided in part by a dart which in the finished garment begins at a seam located at an upper rear side of the upper arm section and terminates adjacent the elbow region.

A garment made according to this aspect of the invention includes sleeves which can more accurately reflect the shape and usual position of the arm whilst, at the same time, avoiding the need for additional panels of fabric and the necessary seams associated therewith.

A still further aspect of the invention provides a method of fabricating a fitted garment including the steps of cutting from a piece of fabric a first panel having a torso section which is adapted to substantially surround the waist region of a wearer's body and which has upper portions configured to extend outwardly in the finished garment to an underarm region of the body such that no seams are present within the armpit region of the body garment shape.

Preferably, the first panel also includes leg sections integrally formed with the torso section. Each leg section is preferably configured to substantially surround at least an upper portion of a leg of the body.

A preferred embodiment of the method includes steps of cutting from a piece of fabric a second panel having an arm section and an upper back section formed integrally therewith and, then, joining the second panel to the first panel such that the arm section forms a sleeve and the upper back section extends across at least a portion of the upper back of the body. Any suitable means for joining the first panel to the second panel may be employed such as, for example, "flat locking", "glued and blind stitching" or any other suitable technique.

In an alternative preferred embodiment the method includes steps of cutting from a piece of fabric a second panel having arm sections, upper back sections and a chest section and, then, joining the second panel to the first panel such that the arm sections form a pair of sleeves, the upper back sections extend between the sleeves across the upper back of the body to meet at a spinal region thereof and the chest section extends between the sleeves across a chest region of the body.

In developing the garment of the present invention, the inventor has gone against conventional thinking and has disregarded economical fabric yield so as to have less seams. In doing so a wetsuit has been created having better function, being warmer, less chance of water entry, less chance of wear due to less seams to stress, and less chance of need for repairs. Whilst a wetsuit produced in accordance with the present invention will require more fabric, thereby increasing the cost, this cost increase will be offset by a quicker manufacturing process, in that there is less cutting and less sewing. There is the same amount of fabric in a wetsuit made in accordance with the present invention as there is in any other suit but there would be more waste due to the unique pattern which keeps the suit relatively in one piece.

A wetsuit made in accordance with the present invention may also be slightly lighter than a conventional wetsuit because of the reduced amount of glue and thread used in the reduced length of seams in the suit. By way of example, a medium sized wetsuit produced in accordance with the preferred embodiment of the present invention has 22' 2.5" of seams compared to the applicant's current "MX" series suit having 45 feet of seams and a Ripcurl "Elasto" suit having about 34 feet of seams.

It is contemplated that garments in accordance with the present invention will generally have reduced total seam lengths. In regard to wetsuits, it is contemplated that embodiments will generally have a seem length of less than 31 feet for small full length suits, less than 32 feet for medium full length suits, and less than 35 feet for large full length suits. It is contemplated that preferred wetsuits will have a total seam length of less than 26 feet for small full length suits, less than 27 feet for medium full length suits, and less than 29 feet for large full length suits. It is contemplated that still more preferred wetsuits will have a total seam length of approximately 21' 2.5" for extra-small full length suits, 21' 8.5" for small full length suits, 22' 2.5" for medium full length suits, 22' 9.5" for large full length suits, 23' 4.5" for extra-large full length suits, and 24' for XXL full length suits, and 24' 7.5" for XXXL full length suits.

The term "full length" is used herein to describe a suit that covers a majority of a wearers arms and extends to the wearer's wrist, and also covers a majority of a wearer's legs and extends to the wearer's ankles. Suits having shorter arms and/or legs will generally have correspondingly reduced total seam lengths. The term "small" is used herein to describe suits that are sized to fit a wearer who is approximately 5' 9" tall and weighs 145 lbs. The term "medium" is used herein to describe suits that are sized to fit a wearer who is approximately 5' 10" tall and weights 160 lbs. The term "large" is used herein to describe suits that are sized to fit a wearer who is approximately 5' 11" tall and weighs 180 lbs.

The garment of the present invention also lends itself to new graphic/logo and printing opportunities, having fewer seams and thus larger continuous fabric surface area with no seams in the way.

It is contemplated that garments in accordance with the present invention may be designed using a method in which minimum total seam length takes precedence over the complexity of individual panels or the amount of material used for each panel, and the amount of material wasted when cutting a panel.

To assist the further understanding of the invention, reference is now made to the accompanying drawings which illustrate preferred embodiments of the present invention. It is to be appreciated that these embodiments are given by way of illustration only and the invention is not to be limited by this illustration.

DETAILED DESCRIPTION

Figure 1:
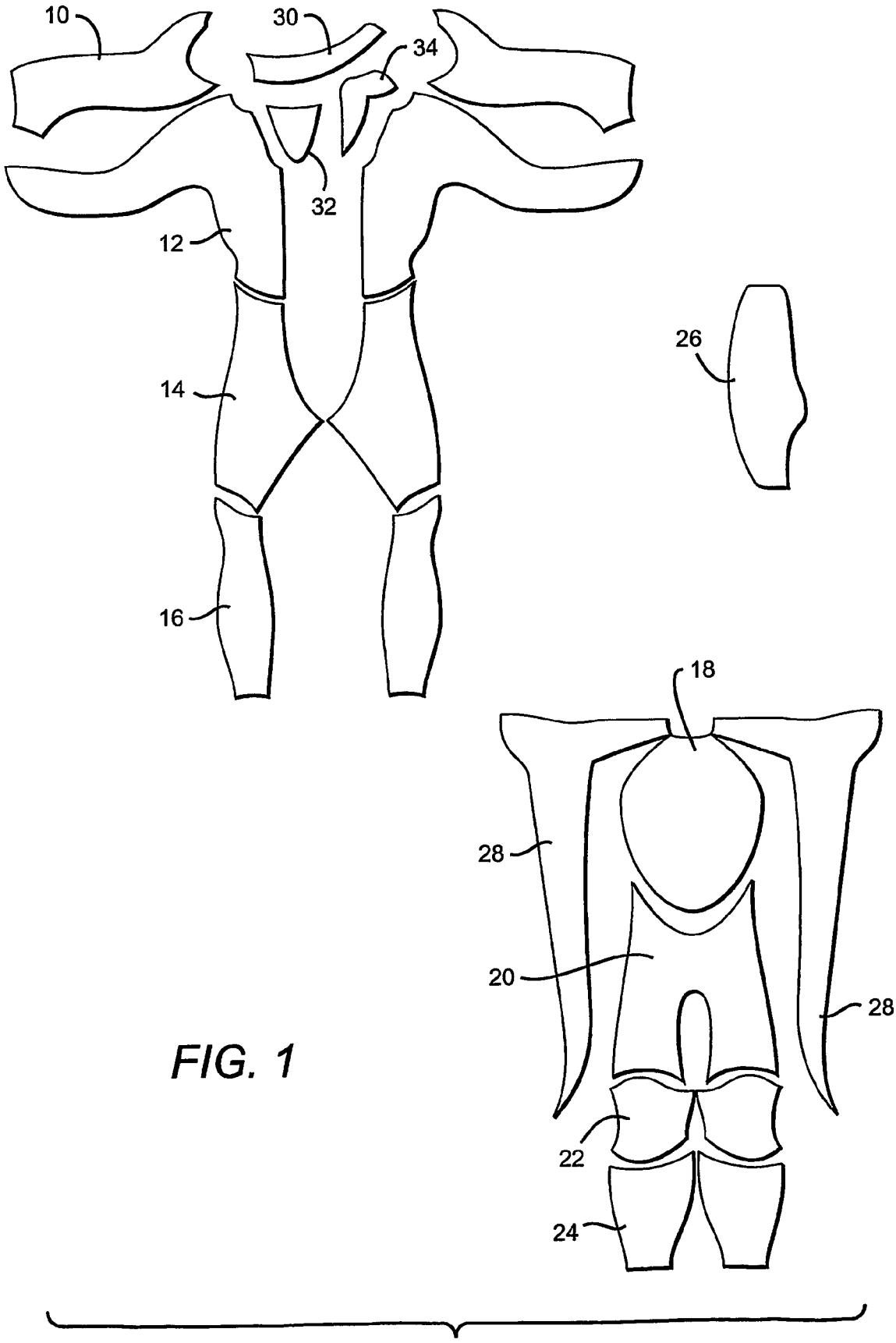
FIG. 1 shows a pattern used to make the applicant's existing "MX" series wetsuit.
Figure 2:
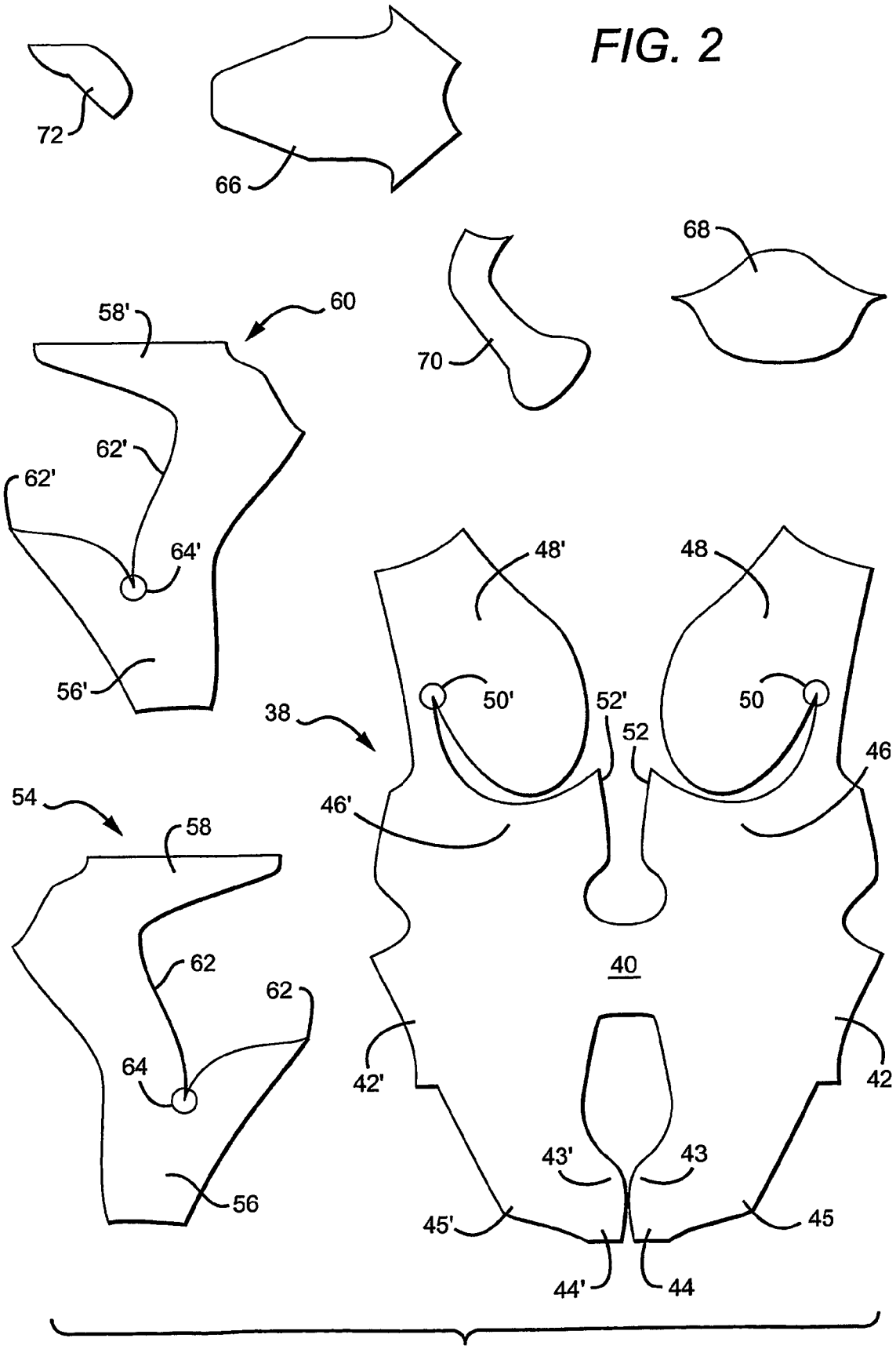
FIG. 2 shows a pattern used to make a full body wetsuit in accordance with a preferred embodiment of the present invention.
Figure 3C:
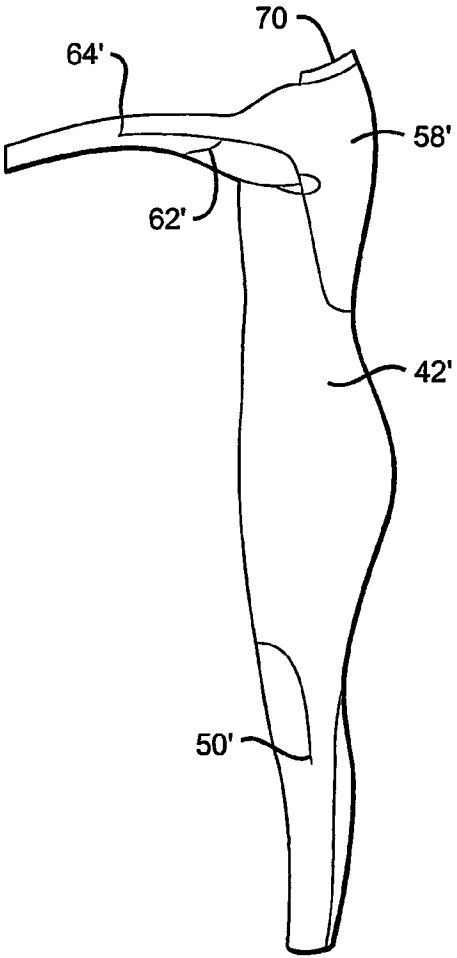
FIGS. 3A to 3C show front, back and side views, respectively, of a finished wetsuit made using the pattern shown in FIG. 2.
Figure 3B:
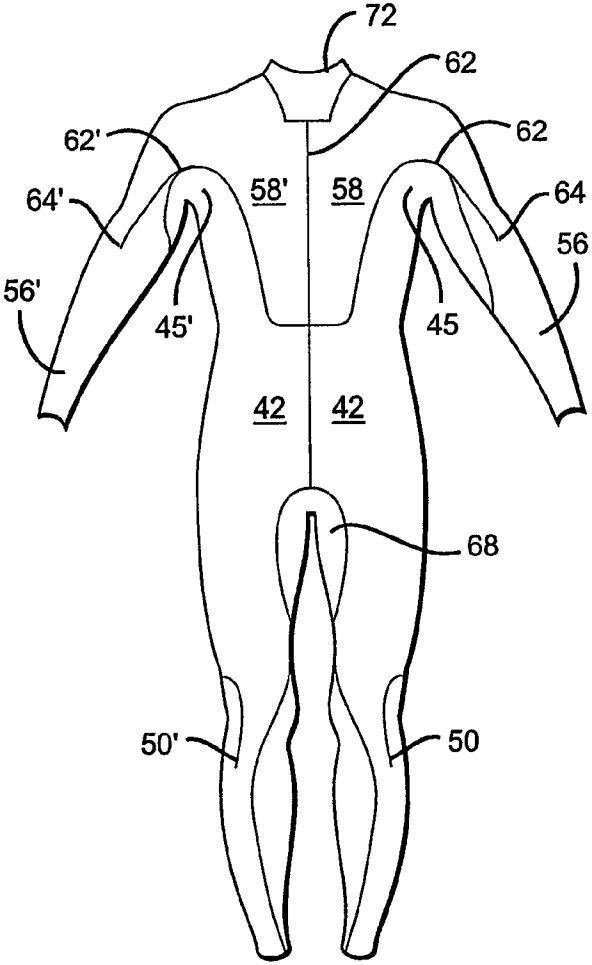
Figure 3A:
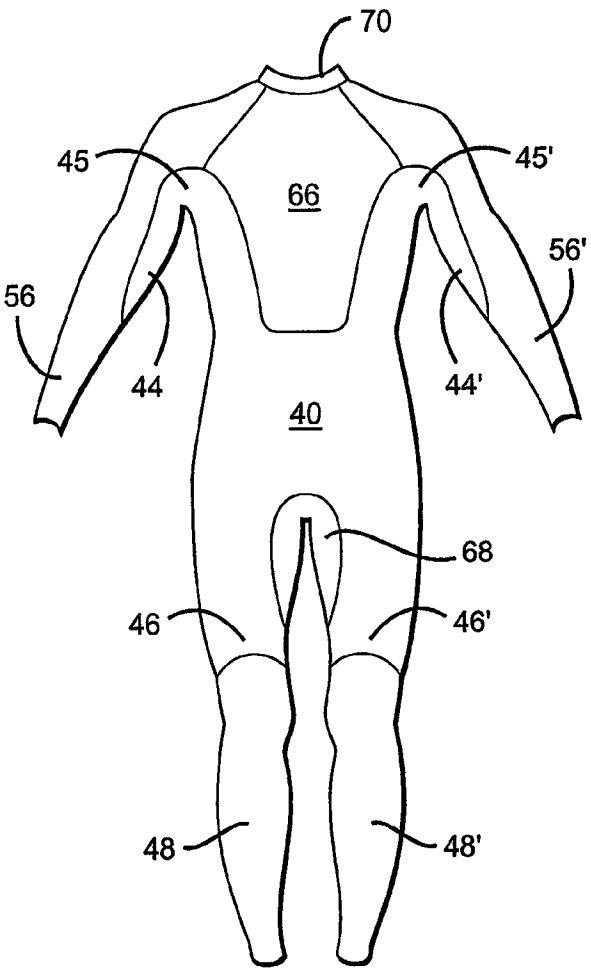
Figure 4:
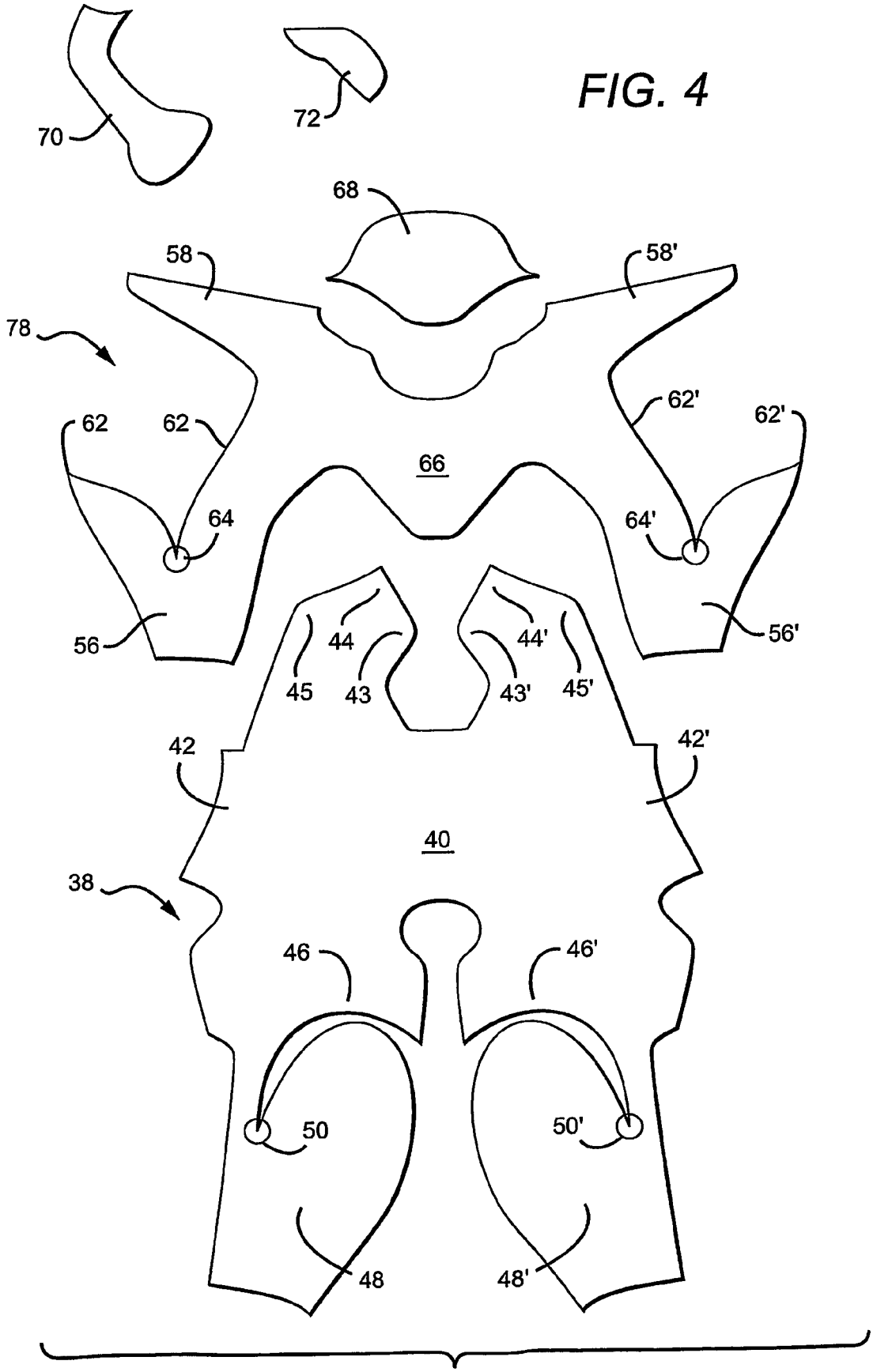
FIG. 4 shows a pattern used to make a full body wetsuit in accordance with another preferred embodiment of the present invention.
Figure 5C:
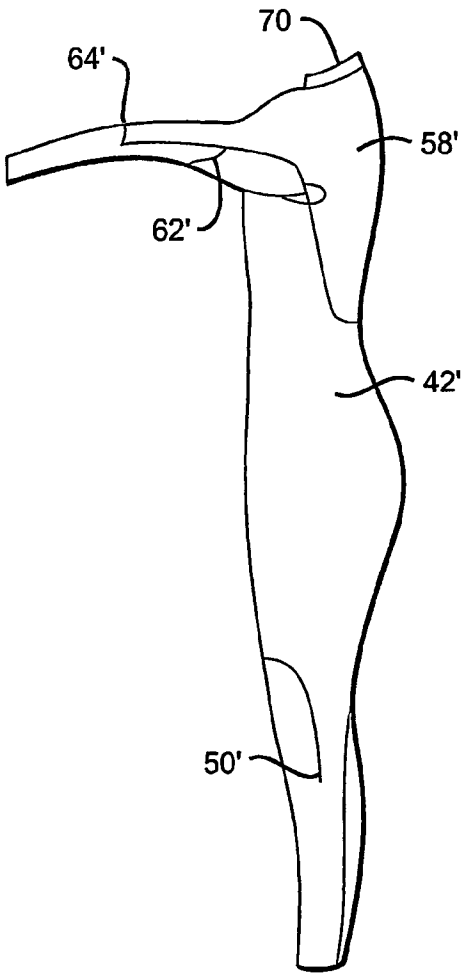
FIGS. 5A to 5C show front, back and side views, respectively, of a finished wetsuit made using the pattern shown in FIG. 4.
Figure 5B:
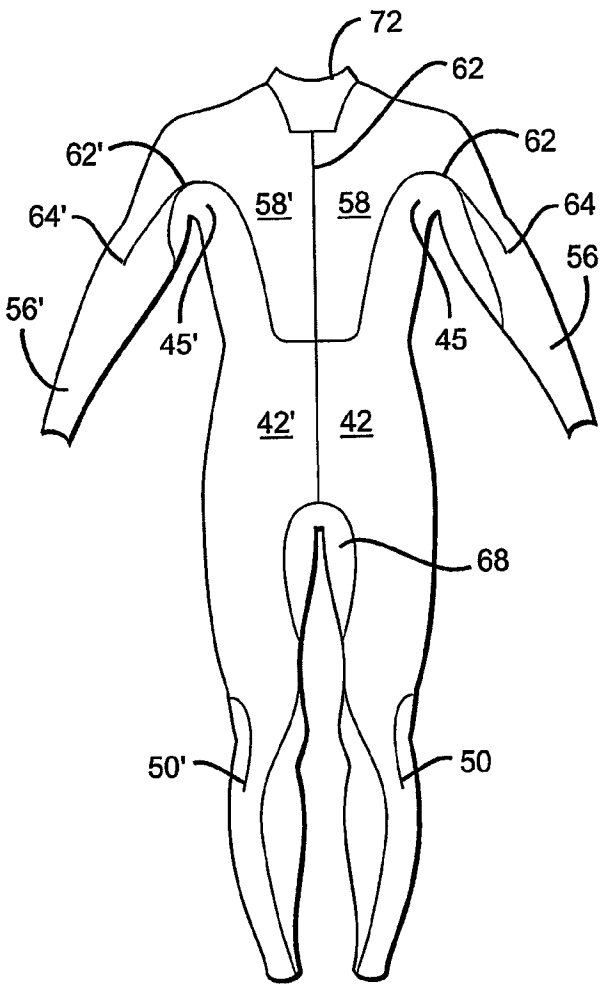
Figure 5A:
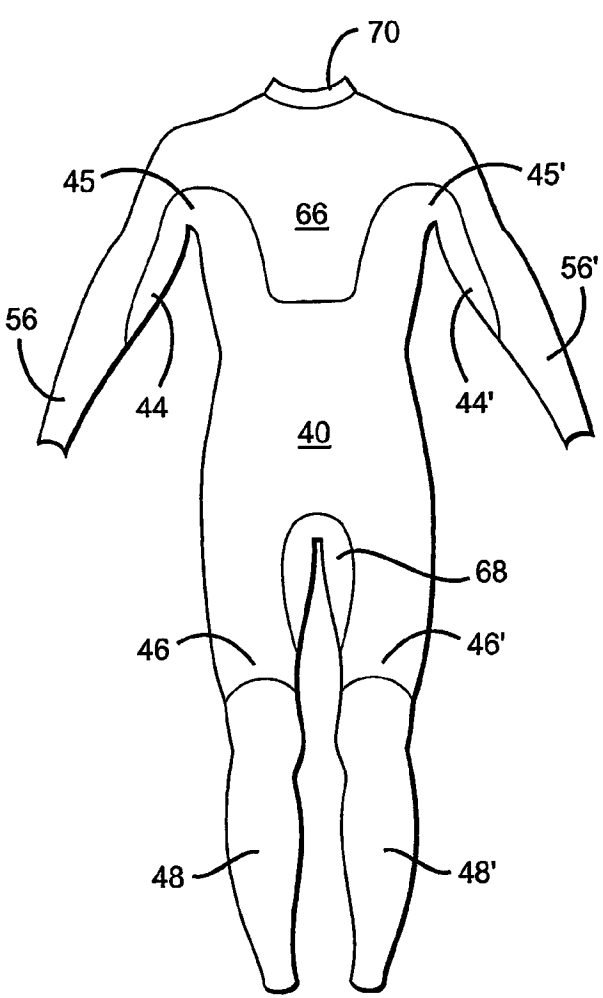

Referring now to the drawings, FIG. 1 shows a standard "MX" series wetsuit made by the applicant. The suit is made up of twenty separate panels that together form a wetsuit having bent arm and leg sections. The suit includes arm panels 10, back panels 12, seat panels 14, lower leg panels 16, a chest panel 18, front body panel 20, knee panels 22, lower leg panels 24, crotch panel 26, gussets 28, collar 30 and neck panels 32 and 34. The total length of the seams (as previously noted, exterior covering seams) in a medium sized wetsuit of this type amounts to 45 feet.

Referring now to FIGS. 2 and 3A to 3C, there is shown a wetsuit produced according to a preferred embodiment of the present invention. This embodiment is made up of seven panels (as previously noted, exterior covering panels). A first panel 38 having a torso section 40 is shaped to surround the waist region of a wearer's body. The two sides 42, 42' of the torso section 40 meet and are joined at a lower spinal region of the body. The torso section 40 also has upper portions 43, 43', 44, 44', 45, and 45' configured to extend outwardly in the finished garment (FIGS. 3A to 3C) to an underarm region of the body such that no seams are present within the armpit region of the body. The first panel 38 also includes leg sections 46, 46', 48, 48' integrally formed with the torso section 40. Each leg section is configured to surround a leg of the body. Each leg section includes a dart which begins at a seam 52, 52' on an inner knee region of the body and which terminates 50, 50' at an outside calf region of the body. It can be seen from FIGS. 3A to 3C that the dart extends from the inner knee region, over the front of the knee and down the outside of the calf.

As can be seen from the figures, the wetsuit of FIGS. 2 and 3A-3C has plurality of panels seamed together but does not have any seams positioned in the underarm area of the suit, and does not include any side or underarm gussets.

The garment also includes a second panel 54 (FIG. 2) having a first arm section 56 and an upper back section 58. A third panel 60 has a second arm section 56' and a second upper back section 58'. The upper back sections 58 and 58' of the second and third panels meet at a zipper 62 in the spinal region. The arm sections 56, 56' form a pair of sleeves that are configured to closely conform to the shape of the wearer's body. Each sleeve has a bend at an elbow region thereof such that the forearm section forms an angle to the upper arm section. This bend at the elbow is provided, at least in part, by a dart which begins 62 at a seam located at an upper rear side of the upper arm section and terminates 64 adjacent the elbow region.

A chest panel 66 is joined to the first panel 38 and extends between the second and third panels 54, 60. The shape and configuration of the upper portions 43, 43' of the torso section 40, together with the shape and configuration of the chest region 66, may be varied to achieve a required three-dimensional garment shape.

Finally, a crotch panel 68, front neck panel 70 and back neck panel 72 complete the wetsuit.

The total length of seams in a medium sized wetsuit produced according to this embodiment of the invention would be about 21 feet. This is significantly less than the 45 feet of seams present in the applicant's current "MX" series wetsuit shown in FIG. 1.

Referring now to FIGS. 4 and 5A to 5C, there is shown another, more preferred, embodiment of the present invention. Similar reference numerals are used in these figures as used in FIGS. 2 and 3 to 3A to refer to similar parts, sections and panels of the wetsuit. The main difference in this embodiment is that the arm and chest sections of the previous embodiment have been formed from a single piece of fabric such that there are only two major panels present in this embodiment. In fact, there are only five panels present in the complete wetsuit.

In this embodiment the first panel 38 has a torso section 40 which is shaped to surround the waist region of a wearer's body. The torso section 40 has upper portions 43, 43', 44, 44', 45, 45' configured to extend outwardly in the finished garment to an underarm region of the body such that no seams are present within the armpit region of the body. A second panel 78 includes integrally formed arm sections 56, 56', upper back sections 58, 58' and a chest section 66. The arm sections 56, 56' form a pair of sleeves, the upper back sections extend across the back of the body and meet at a zipper 62, and the chest section 66 extends between the sleeves across a chest region of the body.

As in the embodiment shown in FIGS. 2 and 3A to 3C, the wetsuit of FIGS. 4 and 5A to 5C includes darts in the arm and leg sections so as to produce the required shaping conforming to the wearer's body and the desired angle at the elbows and knee joints. It will be appreciated that the shape and size of these darts may be varied as required to produce the desired shaping and elbow/knee joint angles.

A medium sized wetsuit produced according to this embodiment of the invention has about 17 feet of seams, thus further reducing the likelihood of water entering the wetsuit via the seams and reducing the susceptibility of the seams to wear and damage.

Although preferred embodiments of the invention are described herein in detail, it will be understood by those skilled in the art that variations may be made thereto without departing from the spirit of the invention or the scope of the appended claims.

For example, the shape, length and position of the darts may be varied as required to produce a garment, such as a wetsuit, having a desired three dimensional body shape and desired angles at the elbows and knees. The depth of the chest piece may also be varied as can be seen by comparing the embodiments depicted at FIGS. 3A and 5A. It will also be appreciated that the wetsuit could be produced having short sleeves and legs, and such a wetsuit, although not incorporating all aspects of the present invention, would still utilise some aspects thereof. Such a wetsuit is considered to clearly fall within the scope of the present invention. One type of garment that is improved by panel and seam reduction is a wetsuit. Wetsuits having reduced panel numbers and seam length will generally keep a surfer warmer and more comfortable and flexible than existing wetsuits. Reduced seem seam length will reduce water entry into the suit and the reduction in water entry increases surfer warmth.

The invention claimed is:

1. A fitted garment comprising:

a first panel of fabric having a torso section which is shaped to substantially surround a waist region of a wearer's body and which has upper portions extending outwardly in a finished garment to both underarm regions of the body such that no seams are present within both armpit regions of the body; and a second panel joined to the first panel and having a first arm section and a first upper back section, wherein the first arm section forms a sleeve and the first upper back section extends across at least a portion of the upper back of the body, the sleeve having a bend at an elbow region thereof such that a forearm section of the sleeve forms an angle to an upper arm section of the sleeve, and wherein the bend comprises a dart which in the finished garment begins at a seam located at an upper rear side of the upper arm section and terminates adjacent the elbow region, the dart comprising only edges of the second panel joined together without creating a fold within the second panel.

2. A fitted garment according to claim 1 wherein the first panel also includes leg sections integrally formed with the torso section, and wherein each leg section surrounds an upper portion of a leg of the body.

3. A fitted garment according to claim 2 wherein each leg section includes a dart which in the finished garment begins at a seam on an inner knee region of the body and terminates at an outside calf region.

4. A fitted garment according to claim 3 wherein a seam extends from the crotch, down the inner thigh region and the knee region, and along a rear portion of the calf region to the ankle.

5. A fitted garment according to claim 4 wherein the dart extends from the inner knee region, over the front of the knee and down the outside of the calf.

6. A fitted garment according to claim 1 further including a third panel joined to the first panel and having a second arm section and a second upper back section, wherein the second arm section forms a second sleeve and the second upper back section extends across a portion of the upper back of the body and meets the first upper back section adjacent a spinal region of the body.

7. A fitted garment according to claim 1 wherein the second panel has integrally formed arm sections, upper back sections and a chest section, wherein in the finished garment the arm sections form a pair of sleeves, the upper back sections extend between the sleeves across the upper back of the body to meet at a spinal region thereof and the chest section extends between the sleeves across a chest region of the body.

8. A fitted garment according to claim 1 wherein the garment is a wetsuit.

9. A fitted garment comprising leg sections closely conforming to the shape of a human body wherein each leg section comprises a single panel of fabric and includes a dart which begins at a seam on an inner knee region of the body and terminates at an outside calf region, the dart comprising only edges of the single panel of fabric joined together.

10. A fitted garment according to claim 9 wherein a seam extends from the crotch, down the inner thigh region and the knee region, and along a rear portion of the calf region to the ankle.

11. A fitted garment according to claim 9 wherein the dart extends from the inner knee region, over the front of the knee and down the outside of the calf.

12. A fitted garment according to claim 9 wherein the garment is a wetsuit.

13. A fitted garment comprising a pair of sleeves closely conforming to the shape of a human body and having a bend at an elbow region thereof such that a forearm section of the sleeve forms an angle to an upper arm section of the sleeve, wherein each sleeve comprises a single panel of fabric and the bend comprises a dart which in the finished garment begins at a seam located at an upper rear side of the upper arm section and terminates adjacent the elbow region, the dart comprising only edges of the second panel joined together without creating a fold within the second panel.

14. A fitted garment according to claim 13 wherein both sleeves comprise a single piece of fabric together with a chest section and upper back sections of the garment.

15. A fitted garment according to claim 13 wherein the garment is a wetsuit.

16. A wetsuit comprising:

a plurality of panels joined together at a plurality of seams, the plurality of panels including a first panel of fabric shaped to substantially surround a waist region of a wearer's body and which has upper portions extending outwardly in a finished garment to an underarm region of the body such that no seams are present within an armpit region of the body; and a second panel joined to the first panel and having a first arm section, wherein the first arm section forms a sleeve, the sleeve having a bend at an elbow region thereof such that a forearm section of the sleeve forms an angle to an upper arm section of the sleeve, and wherein the bend comprises a dart which in the finished garment begins at a seam located at an upper rear side of the upper arm section and terminates adjacent the elbow region, the dart comprising only edges of the second panel joined together without creating a fold within the second panel, wherein the plurality of seams have a total length of less than 32 feet.

17. The wetsuit of claim 16 wherein the plurality of seams have a total length of less than 27 feet.

18. The wetsuit of claim 16 wherein the plurality of seams have a total length of between 20 feet and 25 feet.

19. A method of fabricating a fitted garment comprising the steps of:

cutting from a piece of fabric a first panel having a torso section which is adapted to substantially surround a waist region of a wearer's body and which has upper portions extending in a finished garment to an underarm region of the body such that no seams are present within an armpit region of the body;

cutting from a piece of fabric a second panel having an arm section and an upper back section formed integrally therewith, the first arm section forming a sleeve, the sleeve having a bend at an elbow region such that a forearm section of the sleeve forms an angle to an upper arm section of the sleeve;

forming a dart which begins at a seam located at an upper rear side of the upper arm section of the sleeve and terminates adjacent an elbow region of the sleeve comprising only edges of the second panel joined together without creating a fold within the second panel; and joining the second panel to the first panel such that the upper back section extends across at least a portion of the upper back of the body.

20. A method according to claim 19, wherein the first panel also includes leg sections integrally formed with the torso section, and wherein each leg section surrounds an upper portion of a leg of the body.

21. A method of fabricating a fitted garment comprising the steps of:

cutting a first panel having a torso section which is adapted to substantially surround a waist region of a body, the first panel having upper portions extending to an underarm region of the body such that no seams are present within an armpit region of the body;

cutting a second panel having arm sections, upper backs section, and a chest section, each arm sections forming a sleeve, the sleeve having a bend at an elbow region such that a forearm section of the sleeve forms an angle to an upper arm section of the sleeve;

forming a dart on each arm section beginning at a seam located at an upper rear side of the upper arm section of the sleeve and terminating adjacent an elbow region of the sleeve comprising only edges of the second panel joined together without creating a fold within the second panel; and joining the second panel to the first panel such that the upper back sections extend between the sleeves across the upper back of the body to meet at a spinal region thereof and the chest section extends between the sleeves across a chest region of the body.

* * * * *

UNITED STATES PATENT AND TRADEMARK OFFICE

CERTIFICATE OF CORRECTION

PATENT NO. : 7,665,148 B2
APPLICATION NO. : 10/516850
DATED : February 23, 2010
INVENTOR(S) : Alistair Zorica It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 901 days.

Signed and Sealed this

Seventh Day of December, 2010

David J. Kappos

David J. Kappos
*Director of the United States Patent and Trademark Office*